US007108644B2

(12) United States Patent
Clark, III

(10) Patent No.: US 7,108,644 B2
(45) Date of Patent: Sep. 19, 2006

(54) EXERCISE APPARATUS FOR LOWER LIMB SYSTEM

(76) Inventor: Clarence Edward Clark, III, 15 University Manor East, Hershey, PA (US) 17033

( * ) Notice: Subject to any disclaimer, the term of this patent is extended or adjusted under 35 U.S.C. 154(b) by 316 days.

(21) Appl. No.: 10/290,737

(22) Filed: Nov. 8, 2002

(65) Prior Publication Data

US 2004/0092372 A1 May 13, 2004

(51) Int. Cl.
*A63B 26/00* (2006.01)

(52) U.S. Cl. ..... 482/142; D21/676; D21/686

(58) Field of Classification Search ..... 482/142, 482/148, 98–102, 92–94; D21/676–686, D21/690

See application file for complete search history.

(56) References Cited

U.S. PATENT DOCUMENTS 3,824,994 A 7/1974 Soderberg, Sr.
4,640,268 A * 2/1987 Roberts ..... 601/24
4,711,448 A * 12/1987 Minkow et al. ..... 482/100
5,263,909 A 11/1993 Ehrenfried
5,338,271 A 8/1994 Wang
5,387,169 A 2/1995 Wang
5,499,956 A 3/1996 Habing et al.
5,611,758 A * 3/1997 Rodgers, Jr. ..... 482/57
5,707,321 A 1/1998 Maresh
5,820,519 A 10/1998 Slenker
6,027,430 A 2/2000 Stearns et al.
6,120,416 A 9/2000 Walker
6,152,855 A * 11/2000 Dean et al. ..... 482/4
6,183,397 B1 2/2001 Stearns et al.

* cited by examiner

*Primary Examiner*—Lori Amerson
(74) *Attorney, Agent, or Firm*—Marvin J. Powell, Attorney At Law; Powell Law Associates

(57) ABSTRACT

An exercise apparatus including a torso supporting structure. A drive assembly with an associated resistance is positioned relative to the torso supporting structure. A primary drive member is associated with the drive assembly and is moveable between a first position and a second position to cause the drive assembly to move against the resistance. A secondary drive member is associated with the drive assembly such that as the primary drive member moves between the first and second positions, the secondary drive member moves in conjunction therewith. The secondary drive member is further moveable independent of the primary drive member such that the independent movement of the secondary drive member independently causes the drive assembly to move against the resistance.

16 Claims, 5 Drawing Sheets

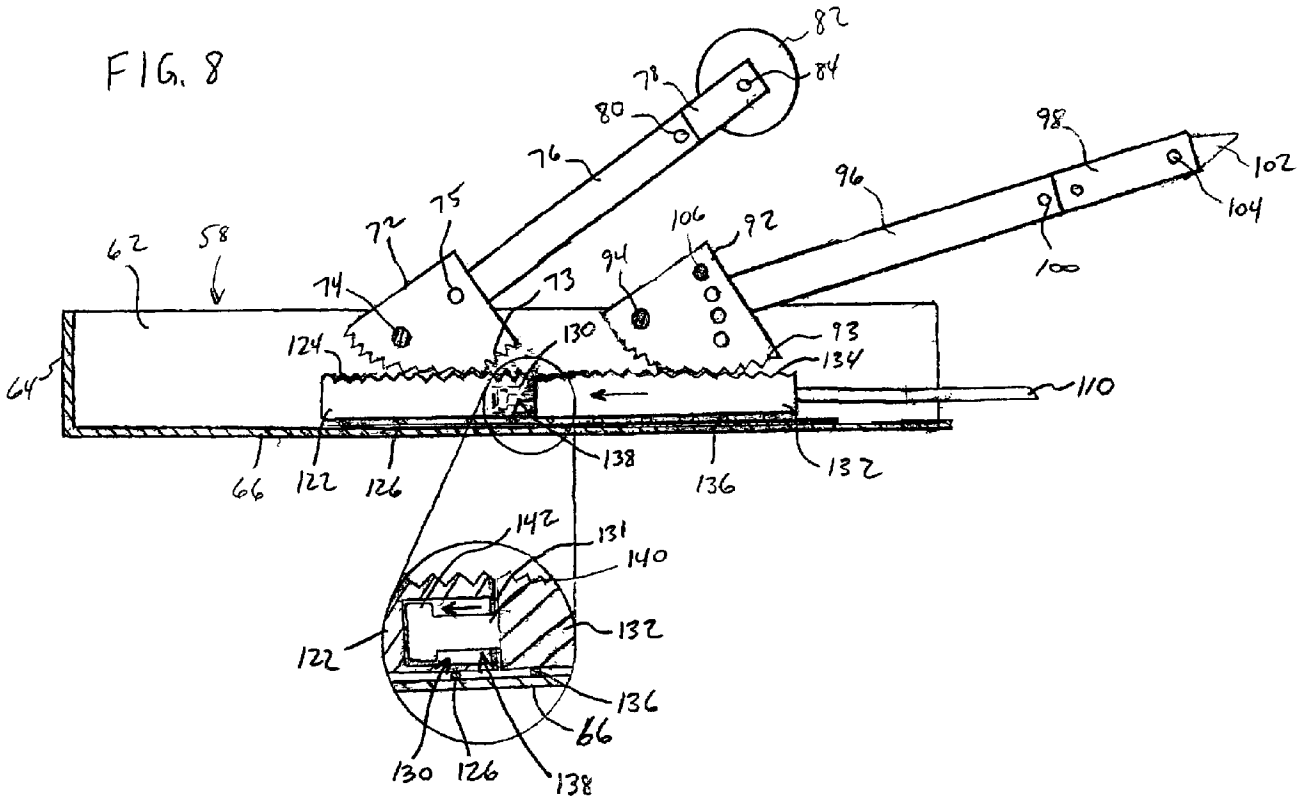
FIG. 8
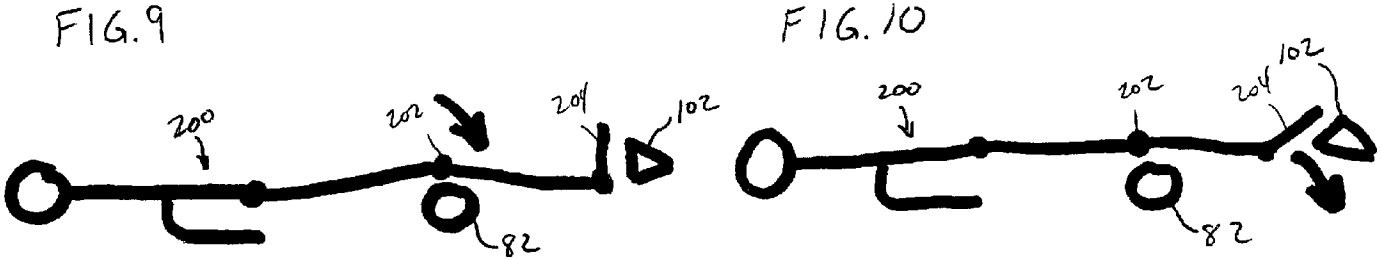
FIG. 9
FIG. 10

EXERCISE APPARATUS FOR LOWER LIMB SYSTEM

BACKGROUND

The present invention relates to an apparatus. More specifically, the present invention relates to exercise equipment. Even more specifically, the present invention relates to exercise and rehabilitation equipment for the lower limb system.

By isolating the lower limb system using the apparatus of the present invention, one optimizes muscle strength when physical activities such as standing, walking, sprinting, jumping, cycling and climbing are performed.

One problem with prior exercising apparatus is that it failed to allow weight or resistance to be placed on the lower limb system in a way that allows it to function optimally.

The following research articles address how the lower limb system functions, when attempting specific body movements, for example, standing, walking, sprinting, jumping, cycling and climbing, which are targets of the apparatus of the present invention.

In normal human gait, the lower limb system, composed of the flexor and extensor muscle groups of the hip, knee and ankle, are active when in motion. However, one uses a different amount of force in each muscle group to go/from standing to walking, to running, cycling or climbing. Scientific tests have been performed to analyze the amount of force exerted by each muscle group when they participate in performing such movements. It was found that each muscle group generates a certain amount of force that changes over time when one stands, walks, runs, jumps and cycles.

Suzuki, S., Watanabe, S. and Homma, S., EMG Activity and Kinematics of Human Cycling Movements at Different Constant Velocities, Brain Research, Volume 240 (1982), pg. 245–258, studied the activity of the rectus femoris, biceps femoris, and gastrocnemius muscles in cyclists. They found that activation time of each muscle was far more advanced when achieving maximum speeds than their flexor counterparts (vastus medius of the thigh and tibialis anterior of the leg). Earlier activation times where also seen in the aforementioned muscle groups of extension relative to the flexors. The biarticulate muscle groups of extension thus demonstrated greater significance when accelerating to maximal speeds in cycling.

Jacobs, Bobbert, Van Ingen Schenau et al, studied explosive leg extension movements, namely jumping and sprinting, and their report was published in *Brain Research* in 1982. They demonstrated a major difference in work done by biarticulate extensors and flexors. They found that the hamstrings in the subjects contributed 7% work in jumping and 11% work in sprinting. This data indicates that these muscle groups are significant in eliciting such movements. The rectus femoris and gastrocnemius muscles, however, contributed 21% and 25% in jumping and 31% and 28% in sprinting, respectively. With greater contribution to work, the latter muscle groups appear to be the most important workhorses.

Van Ingen Schenau et al, in another study of torque effects in extension, compared biarticulate extensors to monoarticulate extensors of the lower limbs and found different effects between the two muscle groups.

Studies examining the amount of power generated by the extensors of the thigh and leg, independent of one another, were also performed.

Wretenberg, Power and Work Produced in Different Leg Muscle Groups When Rising From a Chair, European Journal of Applied Physiology and Occupational Physiology, Volume 68, (1994), pg. 413–417, tested the power and work output of the thigh extensors in individuals who were asked to stand from a seated position. They found that the extensors of the hip and knee demonstrated the greatest amount of power and work for this movement.

Van Soest et al simulated the action of the gastrocnemius as a biarticulate muscle and as a monoarticulate muscle in a computer program to see if in fact biarticulate muscles generated a more critical response at the knee and ankle when one leaps. They concluded that biarticulate muscle stimulation yields a higher vertical leap than monoarticulate muscle groups (the human body is a well build organism).

SUMMARY

One object of the present invention provides an apparatus that can be used as an exercise machine. Another object of the present invention is to provide an apparatus that can be use to rehabilitate the lower limb system. A further object of the present invention is to provide an apparatus that may be used to strengthen the lower limb system following surgery. Still a further object of the present invention is to provide an apparatus that helps to maximize the development, performance, strength and response of the lower limb system. While still a further object of the present invention is to provide an apparatus that exercises lower limb systems as a unit, as well as focus on individual muscle groups of the lower limb system to optimize strength, size, and response.

The present invention provides an exercise apparatus including a torso supporting structure. A drive assembly with an associated resistance is positioned relative to the torso supporting structure. A primary drive member is associated with the drive assembly and is moveable between a first position and a second position wherein movement of the primary drive member from the first position to the second position causes the drive assembly to move against the resistance. In the preferred embodiment, a secondary drive member is associated with the drive assembly such that as the primary drive member moves between the first and second positions, the secondary drive member moves in conjunction therewith. The secondary drive member is further moveable independent of the primary drive member such that the independent movement of the secondary drive member independently causes the drive assembly to move against the resistance.

BRIEF DESCRIPTION OF THE DRAWINGS

FIG. 8 is a cross-sectional view similar to that in FIG. 3 with the drive members in an final exercise position and the encircled portion further shown enlarged and in cross-section;

FIGS. 9 and 10 are schematic representations of a user in finalizing the exercise position utilizing the exercise apparatus of the present invention in a preferred manner;

DETAILED DESCRIPTION OF THE PREFERRED EMBODIMENTS

The present invention will be described with reference to the accompanying drawing figures wherein like numbers represent like elements throughout. Certain terminology, for example, "top", "bottom", "right", "left", "front", "frontward", "forward", "back", "rear" and "rearward", is used in the following description for relative descriptive clarity only and is not intended to be limiting. The term torso as used herein means the chest, back and abdomen (upper torso) and the pelvis and buttocks (lower torso).

Figure 1:
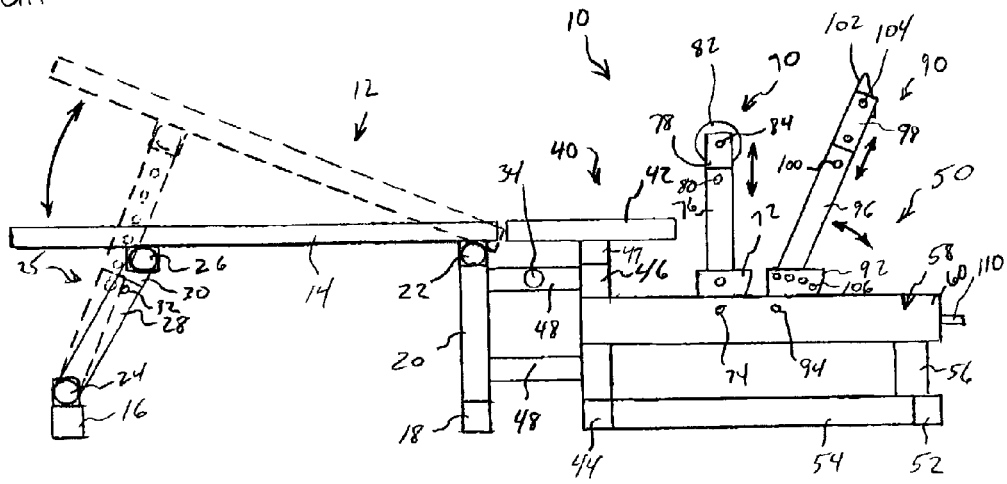
FIG. 1 is a side elevation view of an exercise apparatus that is a first embodiment of the present invention.
Figure 2:
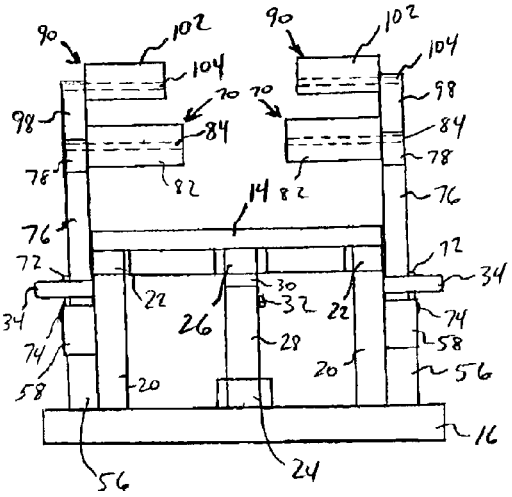
FIG. 2 is an end elevation view along the line 2—2 in FIG. 1.
Figure 3:
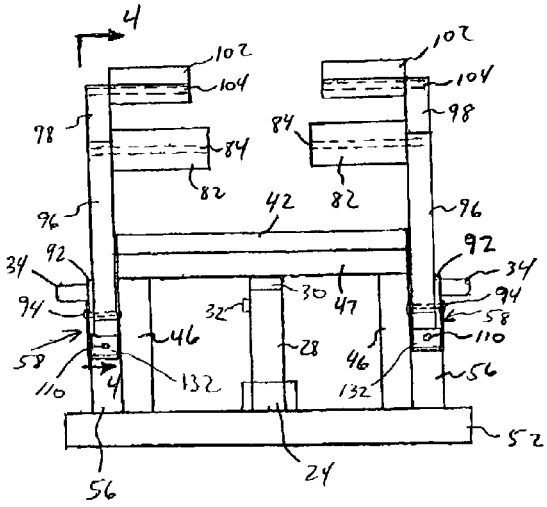
FIG. 3 is an end elevation view along the line 3—3 in FIG. 1.

Referring to FIGS. 1–10, an exercise apparatus 10 that is a first embodiment of the present invention will be described. The preferred exercise apparatus 10 is illustrated in FIGS. 1—3 and generally comprises upper and lower torso supports 12, 40 and a lower limb system 50. The upper torso support 12 includes a bench platform 14 that is pivotally supported at one end by hinges 22 supported by vertical and horizontal frame members 20, 18, respectively. The opposite end of the bench platform 14 is supported by a telescoping assembly 25. The telescoping assembly 25 includes inner and outer tube members 28 and 30 pivotally supported at 24 and 26 between the bench platform 14 and a horizontal frame member 16. The tubes 28 and 30 are locked in a given relationship via a pin 32 or the like. The telescoping assembly 25 allows the bench platform to be inclined over a given range, for example, from a 0 degrees (shown in solid) to a 30 degrees (shown in phantom), although the range may vary, including negative inclines.

The lower torso support 40 includes a support cushion 42 supported on various horizontal and vertical frame members 44, 46, 47. The support cushion is preferably maintained in a fixed position, however, it may also be adjustable, both vertically and horizontally. The support cushion 42 is configured to support the pelvic or hind region. Horizontal frame members 48 preferably extend between the upper and lower supports 12 and 40. In a preferred embodiment, hand grips 34 extend from each side of the exercise apparatus 10 such that the exerciser may hold the grips 34 to keep the user's upper body from moving during exercise.

Extending from the lower support 40 is the lower limb system 50. Various horizontal and vertical frame members 52, 54, 56 support a pair of opposed slider tracks 58 relative to the lower support 40. In addition to the slider tracks 58, the lower limb system 50 includes a pair of opposed primary driver members 70, a pair of opposed secondary driver members 90 and a drive assembly 120 associated with each slider track 58. The preferred system 50 includes opposed pairs to allow independent or simultaneous exercise of the legs, however, it is contemplated that the components may be provided along only one side and extend across the apparatus 10 such that a user can exercise both legs simultaneously. In such an embodiment, individual leg exercise can also be accomplished by engaging only one leg at a time with the lower limb system. Additionally, while the preferred embodiment includes the primary and secondary drive members 70 and 90, the lower limb system 50 may be provided with only one drive member, for example, only the primary drive member 70.

Figure 4:
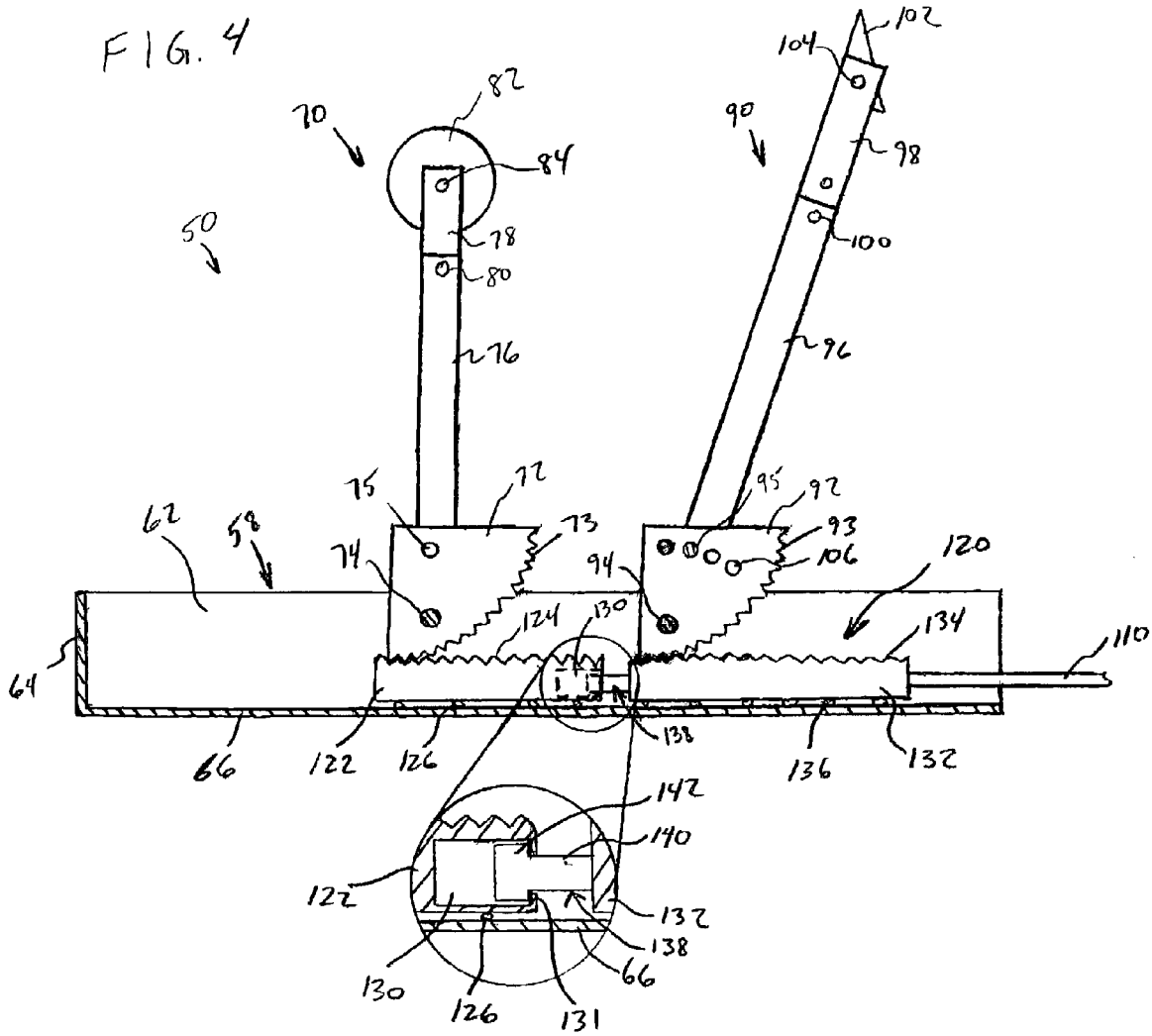
FIG. 4 is a cross-sectional view of the lower limb system taken along line 4—4 in FIG. 3 with the drive members in an initial exercise position and the encircled portion further shown enlarged and in cross-section.

Referring to FIG. 4, one side of the preferred lower limb system 50 will be described. The slider track 58 includes opposed walls 60 (see FIG. 1) and 62 extending from a lower wall 66. An end wall 64 preferably extends between the walls 60 and 62 to limit access into the track 58. A top wall and opposite end wall may also be provided. The primary and secondary drive members 70 and 90 are pivotally supported between the side walls 60 and 62 at 74 and 94, respectively.

The primary drive member 70 extends from the track 58 proximate the lower support 40. The primary drive member 70 is mounted via a quarter-circular shaped mounting plate 72 having teeth 73 along is arcuate edge. An outer tube 76 extends from the mounting plate 72 and is preferably fixed relative to the mounting plate 72 via the pivot pin 74 and a second pin 75. An inner tube 78 extends into the outer tube 76 and is telescopically adjustable relative thereto. A removable pin 80 or the like is utilized to adjust the tubes 76 and 78 relative to one another. The free end of the inner tube 78 has a primary pad 82 extending therefrom. The pad 82 preferably has a cylindrical shape, but may have other configurations. The pad 82 is supported on the tube 78 via a shaft 84 such that the pad 82 may rotate relative to the tube 78.

The secondary drive member 90 extends from the track 58 distal from the primary drive member 70. The secondary drive member 90 is mounted via a quarter-circular shaped mounting plate 92 having teeth 93 along is arcuate edge. An outer tube 96 extends from the mounting plate 92 and is preferably mounted to the mounting plate 92 via the pivot pin 74 and adjustable relative to the mounting plate 92 via a removable pin 95 positional in one of a plurality of holes 106 provided in the plate 92. While the tube 76 of the primary drive member 70 is preferably fixed, it may also be adjustable in a similar manner. An inner tube 98 extends into the outer tube 96 and is telescopically adjustable relative thereto. A removable pin 100 or the like is utilized to adjust the tubes 96 and 98 relative to one another. The free end of the inner tube 98 has a secondary plate 102 extending therefrom. The plate 102 preferably has a triangular shape, but may have other configurations. The plate 102 is supported on the tube 98 via a shaft 104 such that the plate 102 may rotate relative to the tube 98.

The drive assembly 120 of the present embodiment includes first and second drive bars 122 and 132. Each bar 122, 132 is supported in the track 58 on the lower wall 66. Roller bearings 126, 136, respectively, are preferably provided between each bar 122, 132 and the lower wall 66 to allow each bar 122, 132 to slide along the track 58 with minimum resistance. Other types of bearing surfaces or structures may also be provided. Bar 122 has a toothed upper surface 124 and is positioned in the track 58 such that the toothed surface 124 engages the teeth 73 of the primary mounting plate 72. Bar 132 has a toothed upper surface 134 and is positioned in the track 58 behind the bar 122 such that the toothed surface 134 engages the teeth 93 of the secondary mounting plate 92. The bars 122 and 132 are coupled together as shown in FIG. 4. Bar 122 has a rearward cavity 130 configured to receive a protruding member 138 of the other bar 132. The protruding member 138 includes a shaft 140 and a head 142, the head configured to be retained within the cavity 130 via the cavity end wall 131. As such, as bar 122 moves forward, the head 142 contacts the end wall 131 and thereby causes the bar 132 to move in conjunction therewith. The cavity 130 is larger than the head 142 such that the protruding member 138 can move further into the cavity 130, as will be described hereinafter.

A cable 110 extends from the bar 132 and engages a weight system (not shown). As can be seen in FIG. 3, a cable 110 extends from the bar 132 on each side of the apparatus 10. Each cable 110 may engage an independent weight system such that the resistance for each leg can be set independent of the other. Alternatively, both cables 110 may be interconnected to a single weight system, as is known in the art, such that either leg can move the weights or both legs can move the weights simultaneously. The weight system can be positioned at various locations relative to the drive assembly with an appropriate pulley system or the like providing the necessary connection.

Having described the components of the exercise apparatus 10 that is a first embodiment of the invention, its operation will now be described with reference to FIGS. 4–10.

Figure 5:
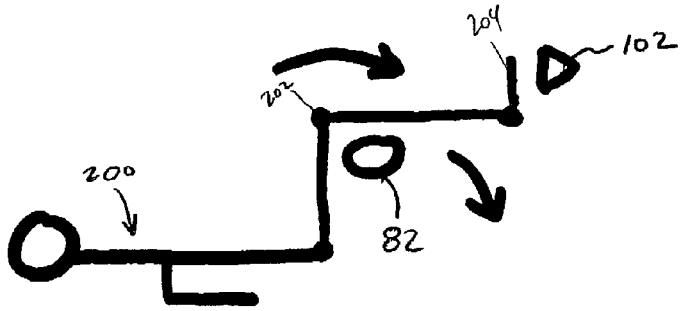
FIG. 5 is a schematic representation of a user in an initial exercise position for utilizing the exercise apparatus of the present invention in a preferred manner.

Referring to FIG. 4, the primary and secondary drive members 70 and 90 and the drive assembly 120 are in an initial position. Referring to FIG. 5, a user 200 is supported on the torso supports 12 and 40 (not shown) with the user's knees 202 proximate the pads 82 and the user's feet 204 proximate the plates 102. The user 200 begins by exerting a force on the pad 82 to drive the primary drive member 70 in an arcuate motion.

Figure 6:
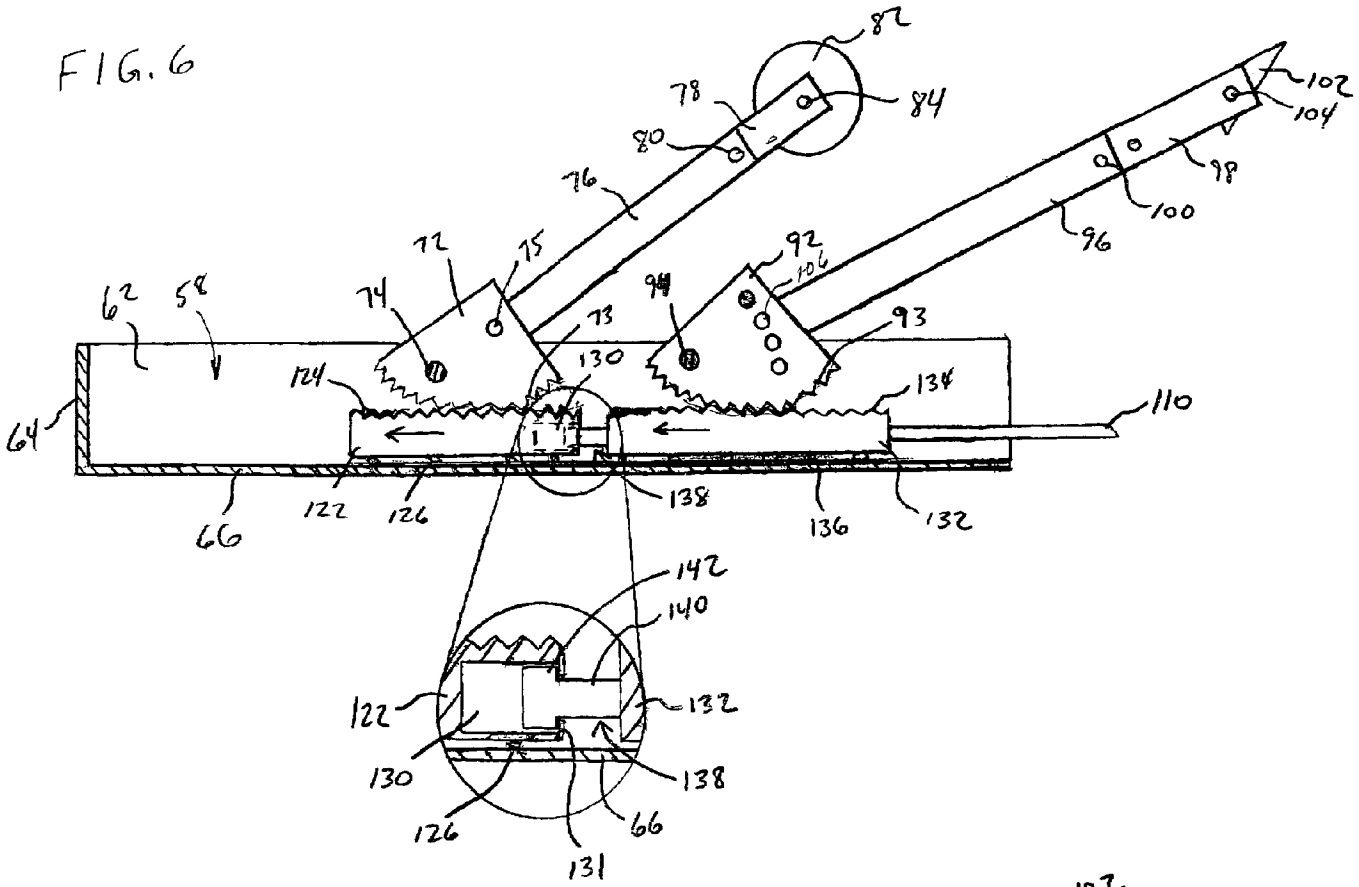
FIG. 6 is a cross-sectional view similar to that in FIG. 3 with the drive members in an intermediate exercise position and the encircled portion further shown enlarged and in cross-section.
Figure 7:
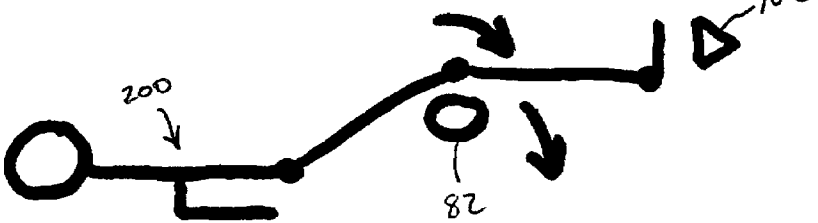
FIG. 7 is a schematic representation of a user in an intermediate exercise position for utilizing the exercise apparatus of the present invention in a preferred manner.

Referring to FIGS. 6 and 7, as the user's legs drive the primary drive member 70 via the contact with the pad 82, the teeth 73 of the mounting plate 72 engage the bar toothed surface 124 causing the bar 122 to move forward. The engagement of the protruding member 138 causes the bar 132, and thereby the weight cable 110, to move forward therewith. The movement of the primary drive member 70 causes the drive assembly 120 to move against the resistance of the weights. Additionally, the interaction between the toothed surface 134 of bar 132 and the teeth 93 of mounting plate 92 causes the secondary drive member 90 to rotate in conjunction with the movement of the primary drive member 70 even without the user 200 exerting any force on the plate 102.

Referring to FIGS. 8–10, the user 200 finishes the primary stroke with the user's legs, moving the pad 82 to a second, extended position. Movement of the pad 82 to the extended position causes the bar 122 to move to a forward position at which it stops. The forward movement of the bar 122 to this point has been against the resistance of the weights via the interaction with the protruding member 138 of bar 132 and the weight cable 110. To complete the secondary stroke, the user's feet 204 are extended against the plates 102, as shown in FIG. 10. Extension of the plate 102 further rotates mounting plate 92 which in turn moves the bar 132 against the resistance of the weights via cable 110. The space in the cavity 130 allows the protruding member 138, and thereby the bar 132, to move forward without moving the bar 122. As such, the secondary stroke may be accomplished independent of the primary drive member 70.

By having the knee and foot pads independent yet coupled the user must contract the thigh muscles first to begin exercise. At around mid-extension the calves then can aid in moving the load, which is linked to both thigh and feet pads. Finally at full extension the calf muscles complete the movement without the aid of the thigh muscles when the user points his toes. When in motion the unit mimics the natural movements seen in climbing, jumping, and running but individually works the muscles that accomplish such movements. Some of the intended advantages of this apparatus are: 1) the patient is lying in a horizontal position to reduce the stress on the hip, knee, and ankle joints created by gravity and body weight. The alleviation of these forces on the weight bearing joints will reduce the progression of osteoarthritis commonly found in the knee, hip, and ankle, 2) in the preferred four-point resistance system, the muscle units can be worked independently to maximize muscle development, 3) the lower limbs can be worked unilaterally, bilaterally, and reciprocally, and 4) placement of the load behind the knee decreases the amount of stress the articulate cartilages must endure, forces the user to work the thigh muscles without complete assistance from the leg muscles, and keeps the entire leg in optimal alignment while the user exercises.

While the illustrated embodiment shows the cavity 130 in bar 122 and the protruding member 138 extending from bar 132, these components may be reversed. Additionally, while the mounting plates 72 and 92 are preferably quarter-circle shaped, other shapes may also be used, including differing shapes between the two plates 72 and 92. Additionally, the teeth on the plates 72 and 92 and the bars 122 and 132 may be varied between one another and within a given plate or surface. Furthermore, a first weight cable may be attached to bar 122 and a second weight cable attached to bar 132 such that the primary and secondary strokes have different resistances.

Figure 11:
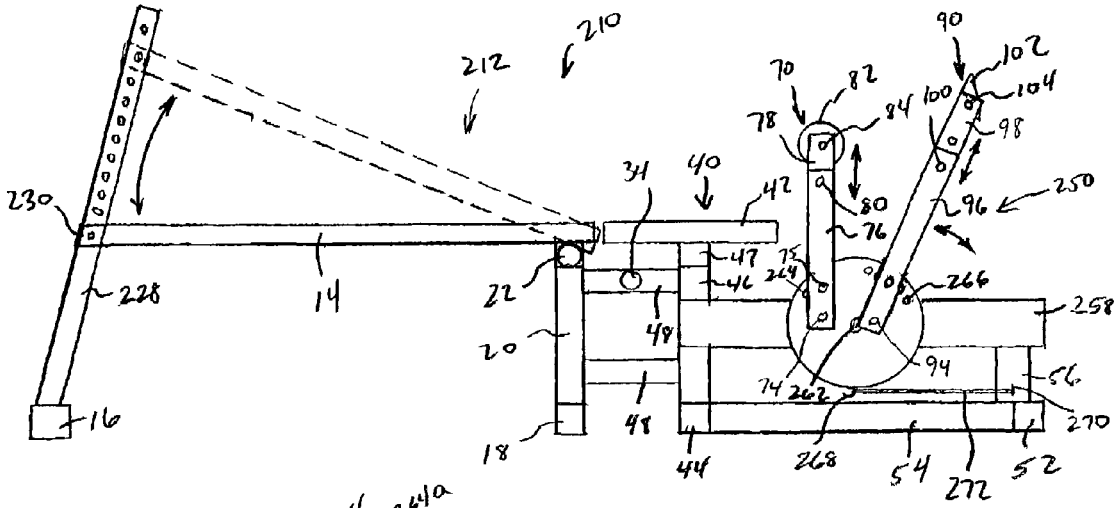
FIG. 11 is a side elevation view of an exercise apparatus that is a second embodiment of the present invention.
Figure 12:
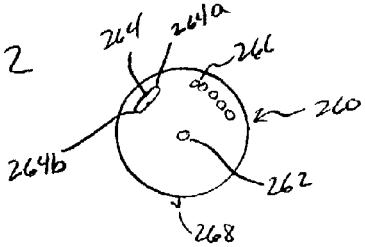
FIG. 12 is a side elevation view of a preferred plate utilized in conjunction with the exercise apparatus of FIG. 11.

Referring to FIGS. 11 and 12 an exercise apparatus 210 that is a second embodiment of the present invention is shown. The exercise apparatus 210 is similar to the previous embodiment and will be described with reference to the differences therein. The upper torso support 212 includes a bench platform 14 supported at one end at hinge 22. The opposite end of the bench platform 14 includes a bracket 230 adjustably securable along an angled vertical support 228 extending from the horizontal frame member 16.

The lower limb system 250 includes a rotatable plate 260 supported on a support plate 258. As shown in FIG. 12, the preferred plate 260 includes a mounting pin 262 for mounting the plate 260 to the support plate 258. The plate 260 also preferably includes a plurality of holes 266 to permit adjustment of the secondary drive member 90 in a manner similar to the first embodiment. The plate 260 also preferably includes a slot 264 extending between slot ends **264*a* and 264*b*. The primary drive member 70 is mounted to the plate 260 such that the pin 75 is received in and moveable along the slot 264. The plate 260 further includes a band hook 268 configured to receive and secure a resistance band 272 extending from a second hook 270 on one of the frame members 56. The number and configuration of the bands 272** can be adjusted to adjust the resistance.

In operation, as a user 200 engages and extends the primary drive member 70, the pin 75 engages the forward end **264*a* of the slot 264, causing the plate 260 to rotate against the resistance from the bands 272. Once the primary stroke is complete, the user 200 extends the plate 102, causing the secondary drive member 90 to further rotate the plate 260. During the secondary rotation, the pin 75 is free to move in the slot 264 toward the rear end 264*a*, thereby allowing the secondary movement independent of the primary drive member 270**.

Figure 13:
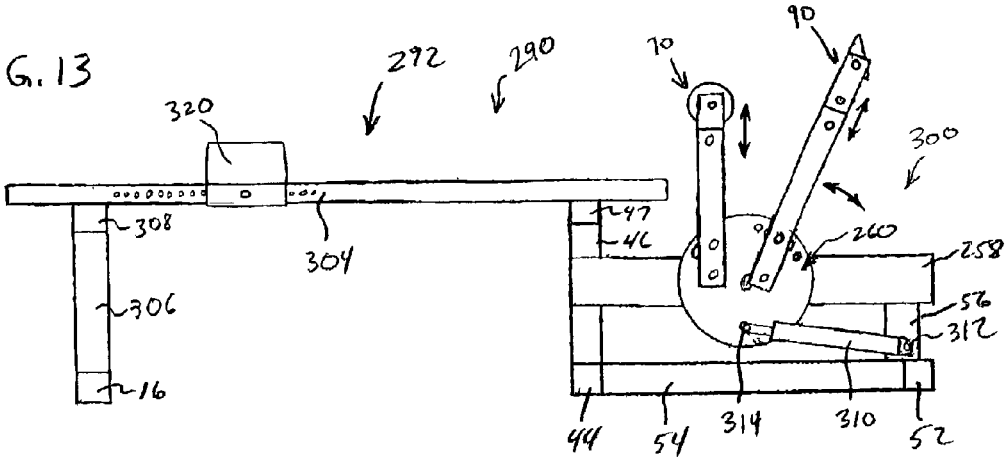
FIG. 13 is a side elevation view of an exercise apparatus that is a third embodiment of the present invention.

Referring to FIG. 13 an exercise apparatus 290 that is a third embodiment of the present invention is shown. The exercise apparatus 290 is similar to the previous embodiments and will be described with reference to the differences therein. The torso support 292 includes a single bench platform 304 fixedly supported by frame members 44, 46, 47 and 16, 306, 308. The torso support 292 further includes an adjustable shoulder pad 320 that assists in preventing lateral movement of the user's torso during exercise. The lower limb system 300 is substantially the same as lower limb system 250, except that a linear actuator resistor 310 is supported between the frame 56 and plate 260 at pivots 312 and 314. The linear actuator resistor 310 may be of the fluid type, for example, an adjustable pneumatic cylinder, an electronic solenoid type, or other configuration.

The various embodiments have been described with various torso supports and various resistance mechanism. Each of these components is interchangeable within the various embodiments. For example, the first embodiment may be provided with a fixed bench platform and resistance bands attached to the bar 132. Additionally, the embodiments illustrated and described above are not intended to be limiting, but are provided only for illustrative purposes. Other configurations, including other arrangements for moving the primary and secondary drive members 70 and 90, may be utilized without departing from the scope of the present invention.

What is claimed is:

1. An exercise apparatus comprising:

a torso supporting structure including upper and lower torso supports and a lower limb system, said structure including a support bench platform configured for supporting at least a portion of a user's torso such that the user's body weight is primarily supported by the supporting structure; said support bench platform adjustable supported by a telescopic assembly;

a drive assembly positioned relative to the torso supporting structure;

a resistance comprising a cable and weight system connected to the drive assembly;

a primary drive member connected with the drive assembly, said primary member having a user contact pad and being pivotally moveable such that the user contact pad is movable between a first position wherein the pad is located proximate to and above the support bench platform, and a second position wherein the pad is spaced from and approximately co-planar with the support bench platform, wherein movement of the pad from the first position to the second position causes the drive assembly to move against said resistance;

a secondary drive member connected with the drive assembly such that as the primary drive member user contact pad moves between the first and second position, the secondary drive member moves in conjunction therewith, said secondary drive member further moveable independent of the primary drive member causing the drive assembly to move against the resistance;

a plurality of horizontal and vertical frame members relative to said lower torso support;

a pair of opposed slider tracks.

2. The exercise apparatus of claim 1 wherein the primary drive member includes a telescopically adjustable tube associated with the user contact pad such that the distance between the pad and the support bench platform can be adjusted.

3. The exercise apparatus of claim 2 wherein the user contact pad is rotatable relative to the adjustable tube.

4. The exercise apparatus of claim 1 wherein at least a portion of the torso supporting structure is configured for pivotal adjustment.

5. The exercise apparatus of claim 1 further comprising a pair of opposed primary drive members, each primary drive member associated with the drive assembly such that the opposed primary drive members are configured to simultaneously or independently move the resistance.

6. An exercise apparatus comprising:

a torso supporting structure including upper and lower torso supports and a lower limb system, said structure including a support bench platform configured for supporting at least a portion of a user's torso such that the user's body weight is primarily supported by the supporting structure; said support bench platform adjustable supported by a telescopic assembly;

a drive assembly positioned relative to the torso supporting structure wherein the drive assembly includes a first and a second bar, the first bar having a partially open cavity configured to receive a headed pin extending from the second bar, the headed pin moveable within the cavity such that movement of the primary drive member causes linear motion of the first bar against a resistance, and the second bar associated with the first bar and a secondary drive member such that motion of the first bar against the resistance causes linear movement of the second bar and the secondary drive member, and, independently, movement of the secondary drive member causes movement of the second bar against the resistance;

said resistance comprising a cable and weight system connected to the drive assembly;

a primary drive member connected with the drive assembly, said primary member having a user contact pad and being pivotally moveable such that the user contact pad is movable between a first position wherein the pad is located proximate to and above the support bench platform, and a second position wherein the pad is spaced from and approximately co-planar with the support bench platform, wherein movement of the pad from the first position to the second position causes the drive assembly to move against said resistance;

a secondary drive member connected with the drive assembly such that as the primary drive member user contact pad moves between the first and second position, the secondary drive member moves in conjunction therewith, said secondary drive member further moveable independent of the primary drive member causing the drive assembly to move against the resistance;

a plurality of horizontal and vertical frame members relative to said lower torso support;

a pair of opposed slider tracks.

7. The exercise apparatus of claim 6 further comprising a pair of opposed primary drive members, each primary drive member associated with the drive assembly such that the opposed primary drive members are configured to simultaneously or independently move the resistance.

8. The exercise apparatus of claim 7 further comprising a pair of opposed secondary drive members, each secondary drive member associated with the drive assembly such that the opposed secondary drive members are configured to simultaneously or independently move the resistance.

9. The exercise apparatus of claim 6 wherein the primary and secondary drive members each move along arcuate paths.

10. The exercise apparatus of claim 9 wherein the secondary drive member has an initial position corresponding to the primary drive member first position, the initial position adjustable along the arcuate path.

11. The exercise apparatus of claim 6 wherein the drive assembly includes a plate mounted for rotatable movement and associated with the primary and secondary drive members.

12. The exercise apparatus of claim 11 wherein the plate includes a slot therein and a pin extends from the primary drive member and is received in and moveable along the slot.

13. The exercise apparatus of claim 6 wherein the resistance includes a system of adjustable weights.

14. The exercise apparatus of claim 6 wherein the resistance includes a system of adjustable resistance bands.

15. The exercise apparatus of claim 6 wherein the resistance includes an adjustable linear actuator resistor.

16. The exercise apparatus of claim 6 wherein at least a portion of the torso supporting structure is configured for pivotal adjustment.

* * * * *